United States Patent [19]

Häfele et al.

[11] 4,286,931

[45] Sep. 1, 1981

[54] FUEL INJECTION PUMP FOR INTERNAL COMBUSTION ENGINES, PARTICULARLY FOR DIESEL ENGINES

[75] Inventors: Walter Häfele, Fellbach; Bernhard Schenk, Schwieberdingen, both of Fed. Rep. of Germany

[73] Assignee: Robert Bosch GmbH, Stuttgart, Fed. Rep. of Germany

[21] Appl. No.: 12,534

[22] Filed: Feb. 15, 1979

[30] Foreign Application Priority Data

Feb. 16, 1978 [DE] Fed. Rep. of Germany ..... 2806477
Feb. 16, 1978 [DE] Fed. Rep. of Germany ..... 2806478

[51] Int. Cl.[3] ..... F02M 59/44
[52] U.S. Cl. ..... 417/490; 417/499
[58] Field of Search ..... 417/490, 494, 499, 493; 123/139 R, 139 AA, 139 AD, 495

[56] References Cited

U.S. PATENT DOCUMENTS

| | | | |
|---|---|---|---|
| 1,757,736 | 5/1930 | Pritchard | 417/490 |
| 2,160,978 | 6/1939 | Mock | 417/490 X |
| 2,545,664 | 3/1951 | Johnson | 417/499 X |
| 3,311,062 | 3/1967 | Knapp et al. | 417/494 X |
| 3,368,491 | 2/1968 | Shook et al. | 417/494 |
| 3,759,637 | 9/1973 | Vuaille | 417/499 |
| 3,989,022 | 11/1976 | Pfister | 123/139 R X |

*Primary Examiner*—Leonard E. Smith
*Attorney, Agent, or Firm*—Edwin E. Greigg

[57] ABSTRACT

A fuel injection pump includes a pump piston which is movably guided in a cylindrical sleeve having a top portion of enlarged diameter which includes a control bore and which is clamped by an annular screw against a shoulder of a reception bore in the pump housing. An annular screw has, in a widened bore portion at least partially surrounding the top portion of the cylindrical sleeve, a pressure shoulder which is recessed relative to the end face of the annular screw presented to the suction chamber and which transmits the clamping force to the cylindrical sleeve. In a further refinement, the annular screw is provided with an annular extension which surrounds the cylindrical sleeve at a distance therefrom in the region of the control bore and whose inner wall forms a protection against impingement of the jet of fuel emerging from the control bore upon the termination of fuel delivery. A widened portion of the bore for receiving the valve member of the pressure valve is disposed in a second portion of the delivery bore which branches laterally, preferably at right angles, from a first portion of the delivery bore which extends coaxially of the longitudinal axis of the pump cylinder, and a screw plug is screwed into an extension of the said first portion. After the screw plug has been removed, the measuring sensor of a pre-stroke measuring device can be mounted onto the pump piston through the first portion of the delivery bore, and thus the dimension of the pre-stroke can be determined.

5 Claims, 3 Drawing Figures

FUEL INJECTION PUMP FOR INTERNAL COMBUSTION ENGINES, PARTICULARLY FOR DIESEL ENGINES

BACKGROUND OF THE INVENTION

The invention relates to a fuel injection pump of the type disclosed, for example, in U.S. Pat. No. 2,565,681, and German published application No. 2,146,797.

In the noted U.S. Patent, the top portion of the cylindrical sleeve and the annular screw are arranged one behind the other, thus increasing the overall height of the injection pump in a disadvantageous manner.

In order to measure the pre-stroke, that is the travel of the pump piston from its bottom dead center position until it closes the control bore and the delivery stroke commences in the injection pump disclosed in the noted German published application, the pressure valve fitted in the extension of the pump piston, and the associated pipe connection have to be removed in order to be able to apply the feeler pin of a pre-stroke measuring device to the end face of the pump piston. This method is necessary particularly when the associated pump housing does not offer the possibility of intervention for a measuring device in the region of the pump piston drive, or when the injection pump is in the form of a plug-in pump and is plugged into the engine housing, so that, here also, the pre-stroke can only be measured on the pump piston.

OBJECT AND SUMMARY OF THE INVENTION

It is a principal object of the invention to improve the fuel injection pump of the type noted above.

The fuel injection pump in accordance with one embodiment of the invention, has the advantage that the overall height of the injection pump can be perceptibly decreased by virtue of a recessed pressure shoulder and a widened bore portion at least partially surrounding the cylindrical sleeve. An advantageous protection against impingement of the fuel jet emerging from the control bore upon termination of injection can be obtained, without additionally increasing the installation space, by an annular extension of the annular screw which surrounds the top portion of the cylindrical sleeve at a distance therefrom in the region of the control bore.

In an injection pump having a pressure valve interposed between the cylindrial sleeve and the pump housing, the overall height of the pump can be further reduced in that a second portion of the delivery bore accommodating a pipe connection, in the form of a screw nipple for a pressure line, branches laterally, preferably at right angles, from a first portion of the delivery bore which is arranged in line with the pressure valve. When in such an injection pump the pressure valve is fitted in the second portion of the delivery bore, the pre-stroke can be measured without removing the pressure valve when a screw plug, removable for the purpose of measuring the pre-stroke, is additionally screwed into an extension of the first portion of the delivery bore. By removing the screw plug screwed into the extension of the first portion of the delivery bore, the fuel injection pump in accordance with the invention renders it possible to obtain simple access for the feeler pin of a pre-stroke measuring device without having to remove any important parts such as the pipe connection and the pressure valve of the injection pump. Furthermore, a very small overall height of the injection pump ensues when the second portion of the delivery bore branches at right angles to the longitudinal axis of the cylinder sleeve. This may be advantageous in the case of cramped conditions on the engine.

In an injection pump in which the part of the injection pump which accommodates the pressure valve, the pipe connection and the delivery bore, is combined with the cylinder sleeve to form a flanged sleeve, the components can be arranged in a manner which facilitates manufacture and which also reduces the dead space, when the first portion of the delivery bore extends within a filling piece inserted into the widened bore position, wherein a cylindrical portion of the screw plug advantageously acts as the filling piece.

A preferred arrangement of all the components, which enables the injection pump to be constructed in a compact manner, ensues when the two portions of the delivery bore together with the screw plug, pressure valve and pipe connection are arranged within a flange-shaped pump housing accommodating the suction chamber of the pump, and when the cylinder sleeve is inserted into the pump housing from the drive side and is clamped by means of an annular screw against a shoulder of a widened bore portion in the first portion of the delivery bore. Pumps of this type are fitted as plug-in pumps into the engine housing. By virtue of the arrangement, in accordance with the invention, wherein the screw is plugged in in line with the pump piston, it is particularly advantageous when only the screw plug has to be removed in order to measure the pre-stroke, although the pressure valve can be left in its fitted state.

BRIEF DESCRIPTION OF THE DRAWINGS

Three embodiments of the invention are illustrated in the drawings and will be further described in the following specification.

DESCRIPTION OF THE PREFERRED EMBODIMENTS

Figure 1:
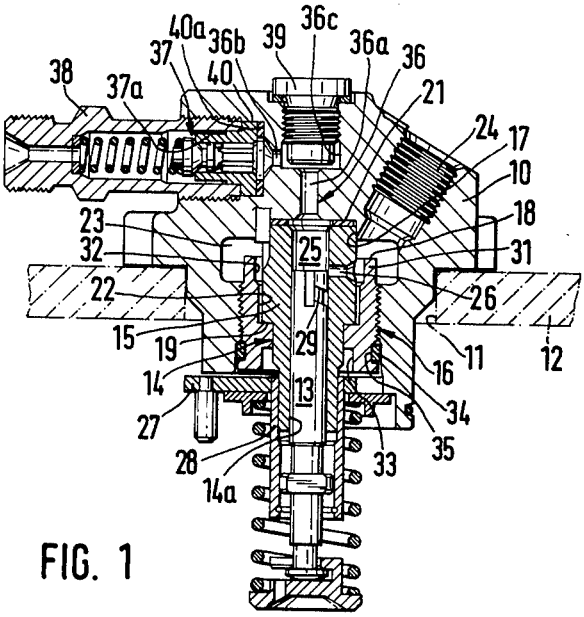
FIG. 1 is a cross-sectional view of the first embodiment of a fuel injection pump in the form of a plug-in pump in accordance with the invention.

FIG. 1 shows the first embodiment of a fuel injection pump which is in the form of a plug-in pump and whose pump housing 10 is fitted into a bore 11 in the engine housing 12 indicated by dash-dot lines. A plug-in pump of this type is driven in a known manner by means of a roller shaft (not illustrated) which is fitted in the engine housing and which is in turn driven by a camshaft of the engine. A cylindrical sleeve 14 for guiding an axially and rotatably movable pump piston 13 has a top portion 15 of larger diameter by means of which the cylindrical sleeve is inserted from the drive side into a reception bore 17 of the pump housing 10 by means of an annular screw 16, the cylindrical sleeve thereby being clamped against a shoulder 21 at the end of the reception bore 17 by means of a pressure shoulder 19 of the annular screw 16 which is recessed relative to the end face 18 at the suction chamber end. The pressure shoulder 19 is formed by a widened bore portion 22 which is machined into the annular screw 16 from the end face 18.

A widened annular-chamber-like portion of the reception bore 17 is disignated suction chamber 23 and is connected to a pre-delivery pump (not illustrated) by way of a bore 24, or directly to the fuel tank which, if required, may be located at a higher level.

The suction chamber 23 surrounds the top portion 15 of the cylindrical sleeve 14 in the region of a control bore 26 which is incorporated in the wall of the top portion 15 of the cylindrical sleeve 14 and which at the same time serves to feed and discharge the fuel to and from a pump working chamber 25. The pump piston 13 is rotatable, for the purpose of varying the delivery quantity, by means of a regulating lever 27 and a regulating sleeve 28 connected to the regulating lever 27, and is provided with an oblique control edge 29 which cooperates with the control bore 26 in a known manner.

In order to prevent damage to the inner wall of the suction chamber 23 by the fuel jet emerging with high energy, upon termination of delivery, from the pump working chamber 25 through the control bore 26, the end of the annular screw 16 which faces the suction chamber 23 is provided with and annular extension 31 which surrounds the top portion 15 of the cylindrical sleeve 14 in the region of the control bore 26. The distance between the annular extension 31 and the outer surface of the top portion 15 of the cylindrical sleeve 14 is such that the flow of fuel between the suction chamber 23 and the pump working chamber 25 is not obstructed, although the inner wall 32 of the extension 31 forms a baffle for protection against the jet of fuel emerging from the control bore 26 upon the termination of delivery. The inner wall 32 is made from hardened steel or, alternatively, can be in the form of an inserted hardened steel ring in the case of very large pumps. In order to be able to screw in the annular screw 16 in a satisfactory manner, the end of the annular screw at the drive side is provided with an internal profile 33 which is adjacent to the pressure shoulder 19 and which is in the form of an hexagonal recess, and a sealing ring 34 is fitted into an annular groove 35 to insure external sealing of the suction chamber 23.

A first portion **36*a* of a delivery bore 36 is incorporated in the pump housing 10 in line with the cylindrical bore 14*a* of the cylindrical sleeve 14, and a second portion 36*b* of the delivery bore 36 branches at right angles from the first portion 36*a* and accommodates a pressure valve 37 in the form of a pressure relief valve, and a pipe connection 38 in the form of a screw nipple which serves to connect a pressure line leading to the injection nozzle and which clamps a valve body 37*a* of the pressure valve 37 against a shoulder 40*a* of a widened portion 40 of the second portion 36*b* of the delivery bore 36. A screw plug 39 for closing the delivery bore 36 is screwed in a pressure-tight manner into an extension 36*c*, of larger diameter, of the first portion 36*a* of the delivery bore 36, the screw plug 39 being removable for the purpose of measuring the pre-stroke of the pump piston 13. This arrangement of the screw plug 39 shown in FIG. 1 permits direct access to the pump piston 13 by means of a measuring device without having to remove the pressure valve 37, since, advantageously, the pressure valve is fitted in the second portion 36*b* of the delivery bore 36 which is arranged at right angles to the first portion 36*a***.

The second embodiment illustrated in FIG. 2 constitutes a variant, of greatly simplified and less expensive construction, of the first embodiment described with reference to FIG. 1. Parts which are the same as those of the first embodiment are provided with the same reference numerals, and parts which are modified with respect to their function or construction are provided with a prime mark. The cylindrical sleeve 14 is inserted into the pump housing 10' from the drive side and is clamped against the shoulder 21 of the reception bore 19 by the annular screw 16' with a valve body 41 of the pressure valve 37' interposed therebetween. Despite the interposed pressure valve 37', the pressure shoulder 19', recessed relative to the end face 18' of the annular screw 16' facing the suction chamber 23', also enables this pump to be of very short construction, since, in the same manner as in the first embodiment of FIG. 1, a second portion **36*b'* of the delivery bore 36' branches at right angles from a first portion 36*a'* arranged in line with the cylindrical bore 14*a*, wherein the first portion 36*a'* also accommodates the valve spring 42 of the pressure valve 37' in a manner which saves installation space. In this embodiment, only a hollow screw 38' serving as the pipe connection which fixes a pressure line 43 directly in the pump housing 10 is screwed into the horizontally extending, second portion 36*b'* of the delivery bore 36' and, owing to the fact that the pressure valve is not arranged in this portion, has a substantially shorter structural length than the pipe connection 38 of FIG. 1**, so that the external diameter of this plug-in pump is also very small.

Figure 3:
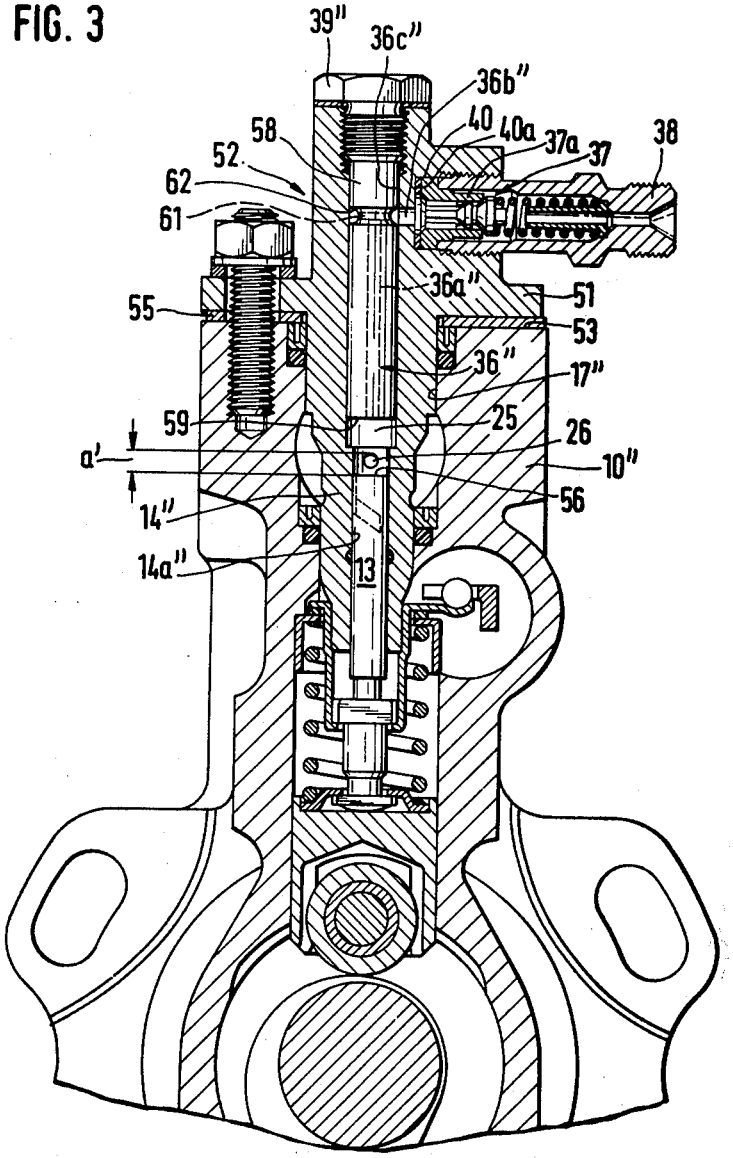
FIG. 3 is a cross-sectional view of a third embodiment of an in-line injection pump provided with a flanged sleeve in accordance with the invention.

The third embodiment illustrated in FIG. 3 constitutes a cross section through an in-line injection pump in the region of one of its pump elements. Parts which are the same as those of the first embodiment described with reference to FIG. 1 are provided with the same reference numerals, and parts which are modified with respect to their function and construction are provided with two prime marks.

A flange-shaped member 51 of the injection pump accommodates the pressure valve 37, the pipe connection 38 and the delivery bore 36'', and is combined with the cylindrical sleeve 14'' accommodating the pump piston 13 to form a flanged sleeve 52. The cylindrical sleeve 14'' of the flanged sleeve 52 is inserted into the reception bore 17'' of the pump housing 10'' from an end face 53 of the pump housing 10'' which is remote from the drive of the pump piston 13. Washers 55 of differing thicknesses for adjusting the pre-stroke of the pump piston 13 can be interposed between the end face 53 of the pump housing 10'' and the flange 51 of the flanged sleeve 52. This pre-stroke is designated a in FIG. 3 and, when the piston 13 is in its bottom dead center position, constitutes the distance between the top end face 56 of the piston 13 and the top edge of the control bore 26. A widened portion **36*c''* of a delivery bore 36'' leading away from the pump working chamber is disposed in line with the cylindrical bore 14*a''* carrying the pump piston 13, and the end of the bore portion 36'' which faces the pump piston 13 forms a portion of the pump working chamber 25. The end of the bore portion 36'' remote from the pump piston 13 receives a screw plug 39'' provided with a cylindrical portion 58 which acts as a filling piece and which is inserted into the widened bore portion 36*c''* to such an extent that it fills the greater part of the bore portion 36*c''*, and its end face 59 facing the pump piston 13 defines the pump working chamber 25 at the delivery end. A first portion 36*a''* of the delivery bore 36'' is incorporated as a blind bore in the filling piece 58 and communicates with a second portion 36*b''* of the delivery bore 36'' by way of a transverse bore 61 and an annular groove 62. In the same manner as in the first embodiment, the valve body 37***a* of the pressure valve 37 is clamped by the pipe connection 38 against the shoulder 40*a* of the widened bore portion 40 of the second portion 36*b*″ of the delivery bore 36″.

The screw plug 39″ can be removed for the purpose of measuring the pre-stroke, and the end face 56 of the pump piston 13 is accessible for the purpose of sensing by means of a feeler pin of the pre-stroke measuring device.

Figure 2:
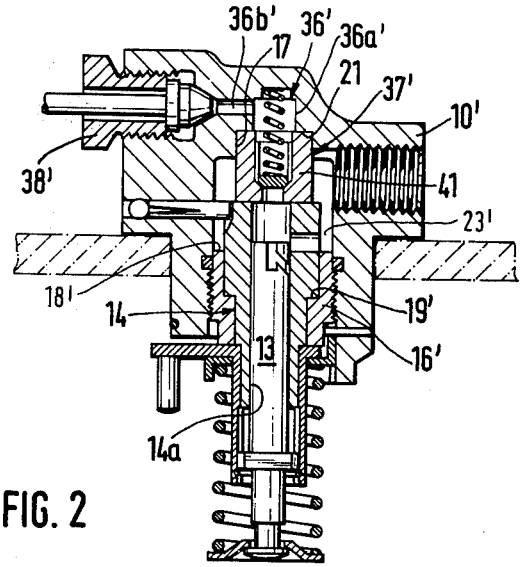
FIG. 2 is a cross-sectional view of a second embodiment of a pump of the type illustrated in FIG. 1.

A small overall height of the pump is rendered possible by the horizontal arrangement of the pipe connections 38, 38′ and the portions 36*b*, 36*b*′ and 36*b*″ respectively of the delivery bores 36, 36′ and 36″ shown in all embodiments of FIGS. 1, 2 and 3. If a small overall height of the pump is not essential, the pipe connections 38, 38′ may be fitted into the pump housing or the flanged sleeve parallel to, and offset relative to, the longitudinal axis of the pump piston. The accessiblilty, in accordance with the invention, of the pump piston 13 for the purpose of measuring the pre-stroke after removing the screw plugs 39 or 39″ can also be obtained when the portions 36*b*, 36*b*′ or 36*b*″ of the delivery bores 36, 36′ or 36″ branches from the first portions 36*a*, 36*a*′ or 36*a*″ at an acute angle, and the pipe connections 38, 38′ and the pressure valve 37 are fitted in a bore (not illustrated) which extends parallel to the cylindrical bores 14*a*, 14*a*′, 14*a*″ and which is offset laterally relative thereto.

The foregoing relates to preferred embodiments of the invention, it being understood that other embodiments and variants thereof are possible within the spirit and scope of the invention, the latter being defined by the appended claims.

What is claimed is:

1. A fuel injection pump for internal combustion engines, particularly a plug-in pump having a drive side for diesel engines, comprising:

a housing defining a reception bore having a threaded opening to the drive side and a shoulder which is opposite the threaded opening and partly defining a suction chamber;

a cylindrical sleeve secured to the reception bore, said sleeve defining a pump piston bore within which a working chamber is defined, and a top portion of larger diameter within which at least one control bore is defined;

a pump piston mounted within the pump piston bore for axial and rotational movement therein, said piston having a control edge which serves the purpose of varying the fuel delivery quantity and co-operates with said at least one control bore in said sleeve for varying the communications between the suction chamber and the working chamber; and an annular screw which engages the reception bore opening such that the annular screw generates a force toward the reception bore shoulder to clamp the top portion of the sleeve against the reception bore shoulder, wherein:

the annular screw includes a widened bore portion which surrounds a portion of the top portion of the sleeve, said widened bore portion defining an end face, facing the suction chamber, and a pressure shoulder recessed relative to the end face, said pressure shoulder serving to transmit the clamping force to the sleeve.

2. The fuel injection pump as defined in claim 1, wherein:

the annular screw further includes an annular extension which defines said end face, said annular extension surrounds the top portion of the sleeve in the region of said at least one control bore at a distance therefrom which does not obstruct flow of fuel between the suction chamber and the working chamber, with the interior wall of the annular extension serving as a baffle for protection against the fuel jet emerging from said at least one control bore upon termination of fuel delivery.

3. The fuel injection pump as defined in claim 2, wherein:

at least the interior wall of the annular extension is made from hardened steel.

4. The fuel injection pump as defined in claim 1, further comprising:

a delivery bore including a first portion arranged in line with the pump piston bore, and a second portion branching laterally, preferably at right angles, from the first portion; and a pressure valve accommodated within the second portion of the delivery bore, said pressure valve having a pipe connection in the form of a screw nipple for connecting a pressure line of an injection nozzle to the pump.

5. The fuel injection pump as defined in claim 4, further comprising:

a screw plug, and wherein:

the delivery bore further includes an extension of the first portion into which the screw plug is screwed, said screw plug being removable for the purpose of measuring the pre-stroke of the pump piston.

* * * * *